United States Patent [19]

Clark

[11] 4,135,602

[45] Jan. 23, 1979

[54] SELECTIVELY POSITIONED MUFFLER

[75] Inventor: Melvin D. Clark, West Unity, Ohio

[73] Assignee: The Aro Corporation, Bryan, Ohio

[21] Appl. No.: 798,994

[22] Filed: May 20, 1977

[51] Int. Cl.[2] ..... F01N 3/00

[52] U.S. Cl. ..... 181/230; 181/256; 181/264; 173/DIG. 2; 417/312; 418/181; 418/270

[58] Field of Search ..... 181/230, 231, 264, 256; 173/DIG. 2; 417/312; 418/181, 270

[56] References Cited

U.S. PATENT DOCUMENTS

| | | | |
|---|---|---|---|
| 2,774,439 | 12/1956 | Chesser | 181/264 |
| 4,042,062 | 8/1977 | Tooley | 173/DIG. 2 |

*Primary Examiner*—L. T. Hix
*Assistant Examiner*—Benjamin R. Fuller
*Attorney, Agent, or Firm*—Allegretti, Newitt, Witcoff & McAndrews

[57] ABSTRACT

A muffler is integrally incorporated with a pneumatic tool by cooperating with the tool housing intermediate the air exhaust chamber for the air motor and atmosphere. An inwardly dished muffler shell includes an exhaust inlet for receipt of exhaust air from the air motor. The shell is selectively positionable and may be combined with screen and additional muffler material as well as a retaining plate in any of a number of combinations to provide distinctive muffling characteristics for the air tool.

6 Claims, 5 Drawing Figures

SELECTIVELY POSITIONED MUFFLER

BACKGROUND OF THE INVENTION

In a principal aspect, the present invention relates to an air muffler construction and more particularly to a selectively positionable muffler incorporated as a part of a pneumatic tool. To promote consumer acceptance of pneumatically operated tools and, in some instances, to comply with governmental noise regulations, it has been necessary to include air muffler devices as a part of the tools. Generally, such air muffler devices are "add on" items which may be attached to an exhaust port of an air tool. As "add on" items, such mufflers may protrude from the air tool where they are easy targets for damage or interference. Thus, it becomes desirable to include a muffler construction integral with an air tool.

However, with muffler constructions, a considerable loss in power by the air tool may be noted. That is, power is reduced in proportion to the muffling action of the tool. In some instances, such a loss of power may be acceptable. However, it may be necessary to avoid the loss of such power in a tool in order to have it effectively perform an operation.

Thus, a muffler construction which is integral with a tool is desirable. Additionally, a muffler which can be adjusted for various noise levels and power outputs as required by the circumstances and operation to be performed is also a desirable objective.

SUMMARY OF THE INVENTION

Briefly, the present invention comprises a muffler construction for an air tool which is selectively positionable to provide distinctive silencing characteristics and associated power characteristics for the tool. The muffler is integrally incorporated in the housing of the air tool. The housing generally surrounds the air motor and includes an opening in opposed relation to the air motor exhaust port. A muffler shell fits within the opening and divides the chamber defined between the housing and air motor. An opening in the muffler shell wall may be selectively positioned to receive exhaust air from the motor exhaust port substantially directly or by means of a circuitous route. Additionally, various combinations of muffling material and screen material as well as a perforated retainer plate may be incorporated with the muffler shell to provide distinctive and numerous muffling characteristics.

Thus, it is an object of the present invention to provide an air muffler which may be integrally incorporated in an air tool.

It is a further object of the present invention to provide an air muffler which is selectively positionable in any one of a number of modes.

Still a further object of the present invention is to provide a selectively positionable air muffler which may be adjusted easily and quickly with a minimum of down time for the air tool.

Still a further object of the present invention is to provide an air muffler construction which is simple to maintain, easy to repair and having a minimum number of parts.

These and other objects, advantages and features of the invention will be set forth in the detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Figure 1:
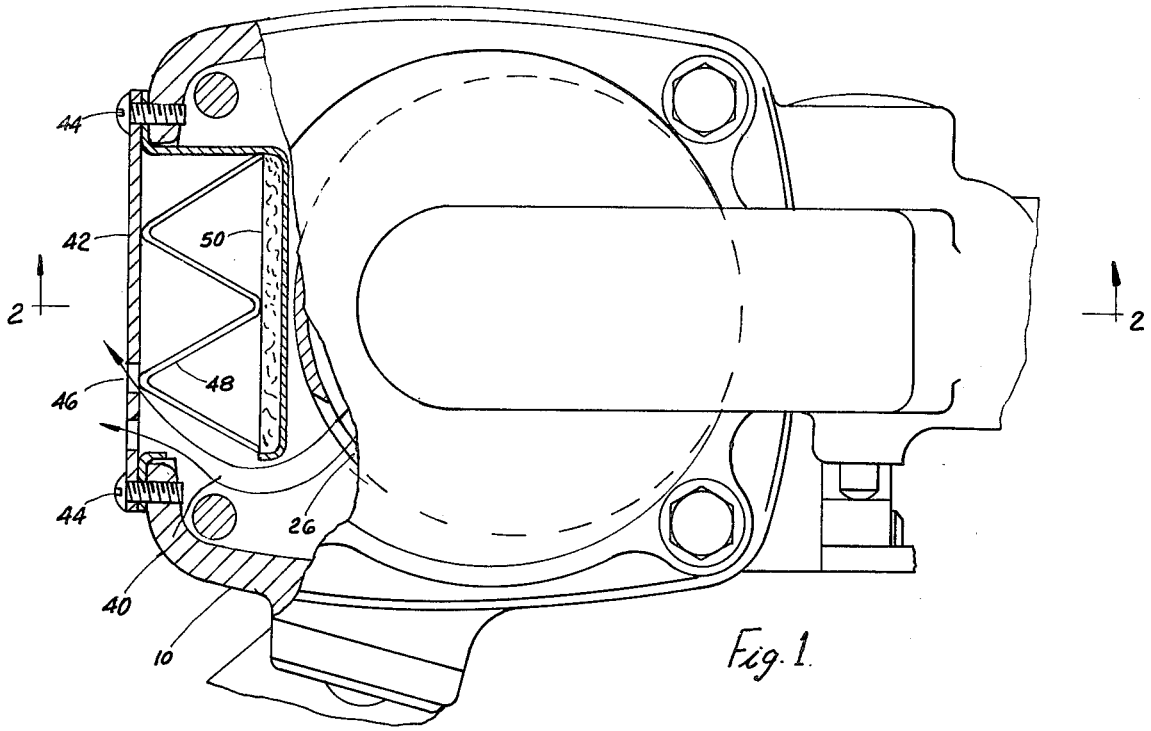
FIG. 1 is a partially cut-away end view of the improved muffler construction of the present invention.
Figure 2:
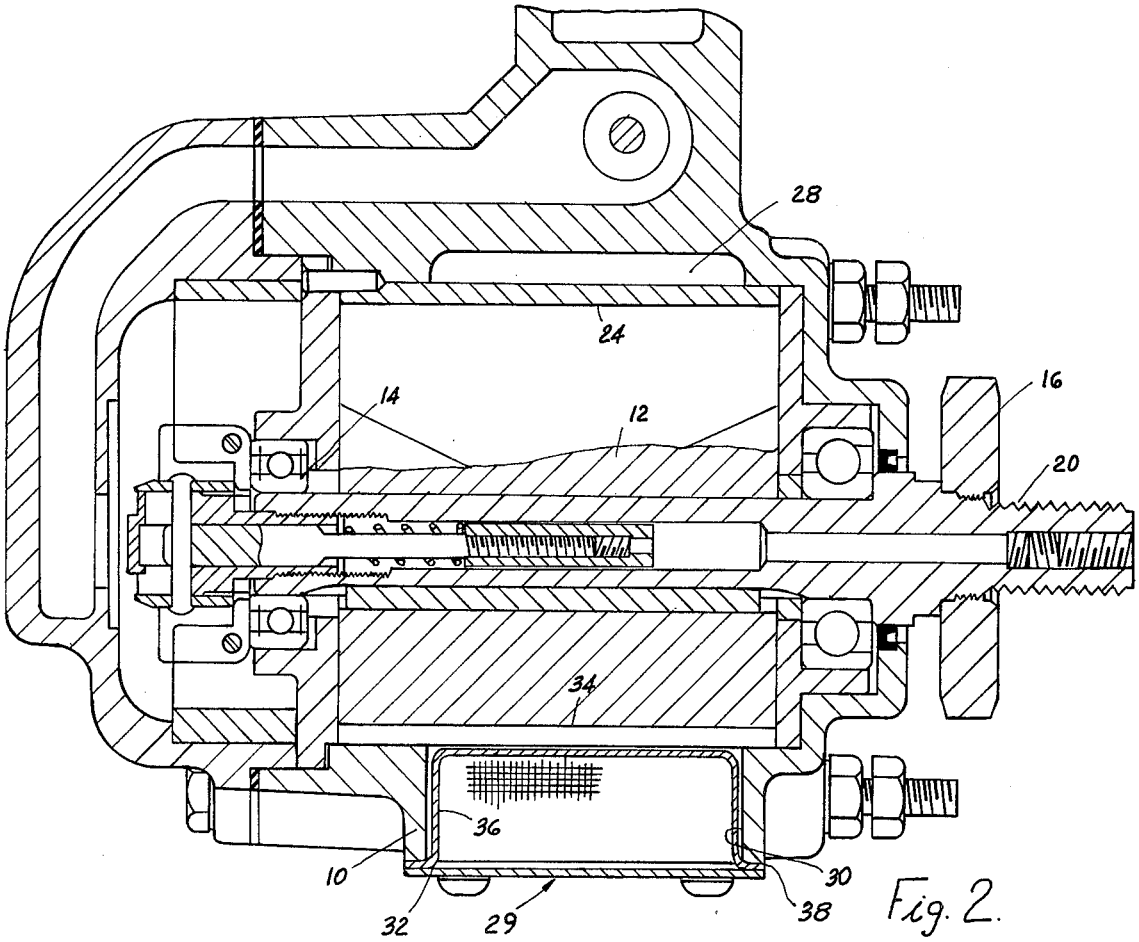
FIG. 2 is a longitudinal cross-sectional view of a typical air tool incorporating the muffler construction of the present invention taken substantially along the line 2—2 of FIG. 1.

As shown in FIGS. 1 and 2, an air tool typically includes an external housing 10, within which an air motor such as a rotary vane air motor 12 is mounted on bearings 14, 16. Bearings 14, 16 are retained by the housing 10. A drive spindle 20 is driven by the rotary vane air motor 12.

The air motor 12 includes a cylindrical casing 24 having an exhaust port 26. The casing 24 in combination with the housing 10 defines a chamber 28 which surrounds the casing 24 and into which exhaust air from the motor 12 passes by way of the exhaust port 26.

The subject matter of the present invention generally relates to the muffler construction 29 which is incorporated within an opening 30 defined in the housing 10. As shown in FIGS. 1 and 2, the muffler construction 29 is comprised of a shell 32 which is dished inwardly toward the motor 12. The shell 32 includes a bottom panel 34 which is maintained in close proximity to the casing 24 of motor 12. Thus, the chamber 28, which generally surrounds the casing 24, is divided or walled by the shell 32.

The shell 32 includes a circumferential side wall 36 as well as a circumferential outer flange 38 which cooperates with the opening 30. The flange 38 is continuous with the opening 30.

Figure 3:
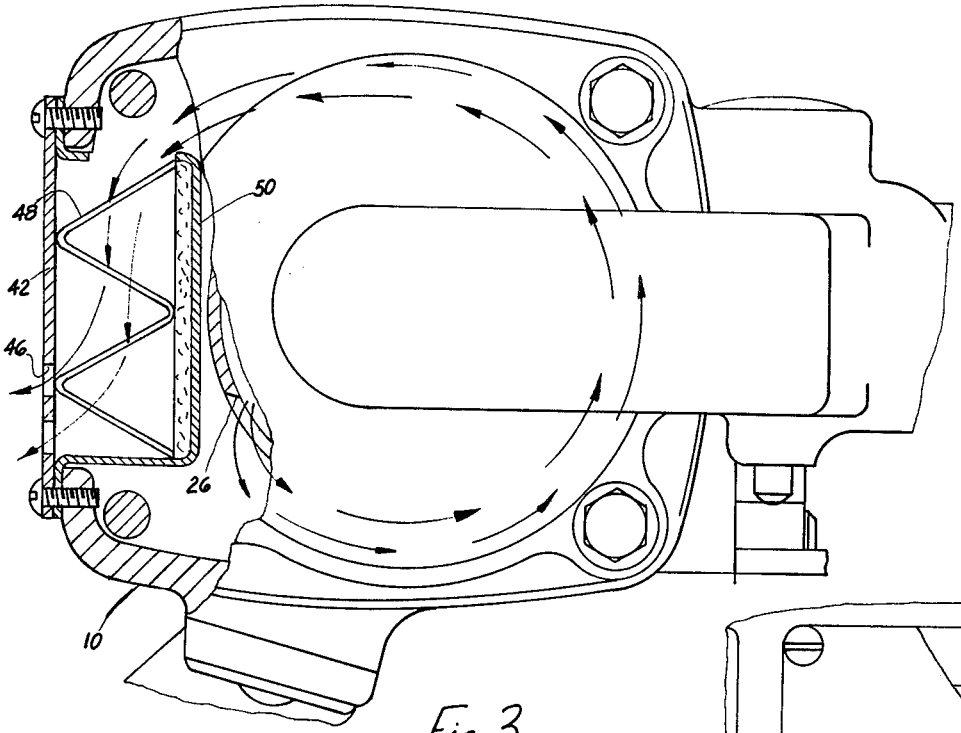
FIG. 3 is a partially cut-away end view of the muffler construction of the invention similar to FIG. 1 wherein the muffler has been adjusted to an alternative mode.
Figure 4:
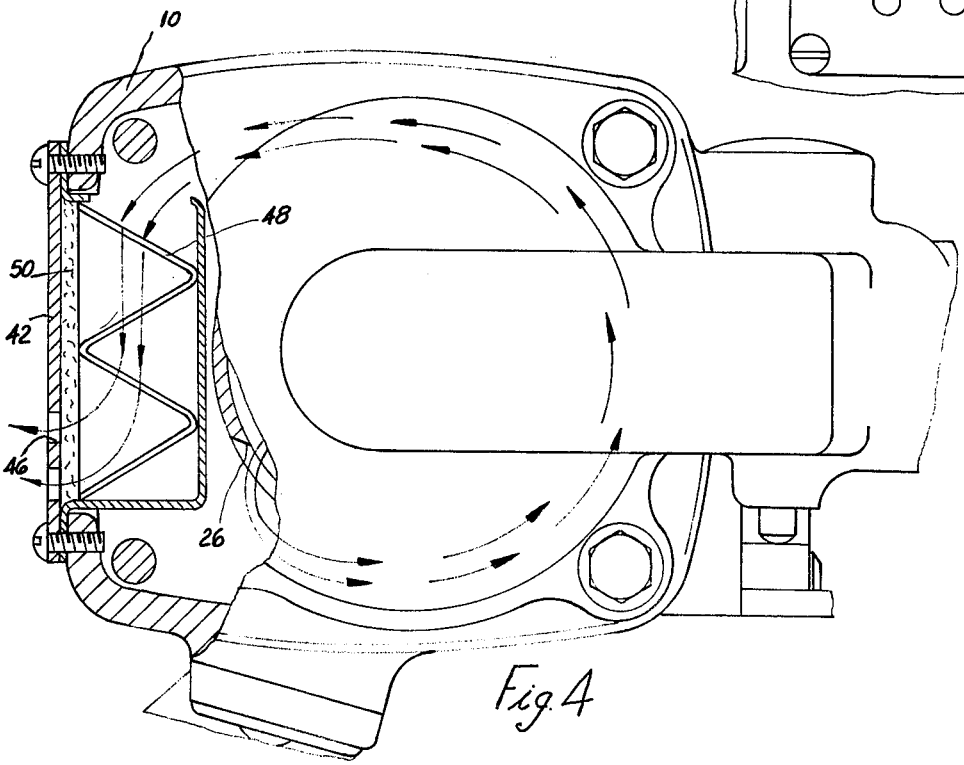
FIG. 4 is a partially cut-away end view similar to FIGS. 1 and 3 wherein the muffler construction has been further adjusted to another distinctive mode of operation.

As shown in FIGS. 1, 3 and 4, a portion of side wall 36 is removed from the shell 32 defining an opening 40. Thus, exhaust air passing from exhaust port 26 may flow through chamber 28 and out of opening 40 in shell 32.

Figure 5:
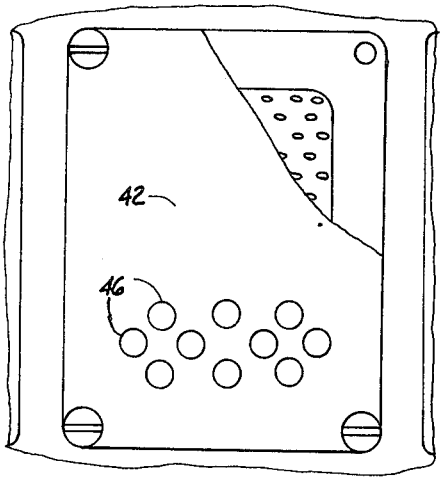
FIG. 5 is a top plan view of the integral muffler partially cut away to disclose the muffler shell and internal construction of the muffler.

A cover plate 42 is attached over the shell 32 and is retained by screws 44. As illustrated in FIG. 5, the plate 42 includes a number of perforations 46 which are arranged in a desired and distinctive pattern.

Positioned intermediate plate 42 and bottom panel 44 is a sinusoidal screen 48. The screen 48 is shown in a sinusoidal form for the purposes of illustration only. Any desired screen shape of any desired mesh may be utilized in order to provide desired and necessary muffling characteristics. In addition to a screen 48, a sound deadening material 50 is positioned within the shell 32.

Thus, the shell 32, plate 42, screen 48 and muffling material 50 in combination with the housing 10 may be adjusted and positioned in any one of a number of ways to provide a desired muffling characteristic. For example, the shell 32 may be positioned as shown in FIG. 1 with a close proximity of exhaust port 26 relative to opening 40 thereby providing a minimum distance path for air exhaust. Note also, that in FIG. 1 perforations 46 are in close proximity to the opening 40. The screen 48 and muffling material 50 play a very small role in the configuration of FIG. 1. The configuration of FIG. 1 is attained by a proper positioning of the component parts in the rectangular opening 30 of the housing 10.

FIG. 3 represents an alternative arrangement for the muffler configuration. In FIG. 3, the shell 32 has been reversed or rotated 180° relative to the position shown in FIG. 1. As a result, air from exhaust port 26 must flow through the chamber 28 around the casing 24 before it can pass through opening 40. The air must also flow through the screen 48 before it can pass through perforations 36 in plate 42. Note that the muffling material 50 does not play a significant role for sound deadening and muffling with regard to the embodiment shown in FIG. 3.

FIG. 4 represents still another possible arrangement of the component parts of the present invention. In FIG. 4, the shell 32 is arranged in the same manner as shown in FIG. 3. The muffling material 50 is, however, placed adjacent the plate 42 and supported in that position by screen 48. The embodiment of FIG. 4 thus provides an even more complete muffling than the embodiment of FIG. 3.

In review, the arrangement of FIG. 1 provides the least muffling and permits the highest power output. The embodiment of FIG. 2 provides improved muffling relative to the embodiment of FIG. 1. The embodiment of FIG. 4 provides even greater muffling. Because different operators have distinct power output and noise level requirements. they can adjust the muffler construction of the present invention as desired. Since the muffler does not project outside of the housing, it is not vulnerable to damage. Finally, it is possible to select a muffling configuration which reduces or eliminates frosting, a common problem in pneumatic tools.

It is possible to vary the muffling characteristics of the construction illustrated in the figures by additional permutations and combinations of shell 32, the screen 48, muffling material 50 and plate 42 having its pattern of perforations 46. The examples are, therefore, illustrative and the invention is limited only by the following claims and their equivalents.

I claim:

1. In an air tool including a rotary vane air motor of the type having a casing, said casing having air exhaust ports, the improvement of integral and variable muffler means comprising, in combination:

a housing for the motor, said housing surrounding the casing to define a chamber surrounding the motor, said housing including an air exhaust opening from the chamber to the atmosphere, said opening generally opposed to the motor exhaust ports; and a muffler shell member positioned in the housing opening and dished inwardly toward the casing, said shell member including a bottom panel which extends in close proximity to the casing and a sidewall from the bottom panel to the opening whereby the shell divides the chamber, said shell including an air passage through part of the side wall, said shell being selectively positioned in the opening to place the shell air passage adjacent the exhaust ports of the motor or distal from the exhaust ports to thereby control the path of exhaust air travel from the exhaust ports, through the chamber and through the air passage.

2. The improvement of claim 1 in combination with a perforated plate over the muffler shell and opening to define a secondary exhaust chamber within the shell.

3. The improvement of claim 2 wherein the perforated plate includes a pattern of perforations selectively positionable with respect to the air passage in the muffler shell.

4. The improvement of claim 1 in combination with a screen member, said screen member being retained in the shell and positionable in the path of exhaust air flow through the shell.

5. The improvement of claim 1 including sound deadening material positioned in the shell in the path of exhaust air flow through the shell.

6. The improvement of claim 1 wherein said shell is a generally rectangular inwardly dished member having said passage in a side wall of the inwardly dished shell.

* * * * *